US006190784B1

(12) United States Patent
Maus et al.

(10) Patent No.: US 6,190,784 B1
(45) Date of Patent: Feb. 20, 2001

(54) CONICAL HONEYCOMB BODY WITH LONGITUDINAL STRUCTURES

(75) Inventors: Wolfgang Maus; Rolf Brück, both of Bergisch Gladbach (DE)

(73) Assignee: EMITEC Gesellschaft fuer Emissionstechnologie mbH, Lohmar (DE)

( * ) Notice: Under 35 U.S.C. 154(b), the term of this patent shall be extended for 0 days.

(21) Appl. No.: 09/221,781

(22) Filed: Dec. 28, 1998

Related U.S. Application Data

(63) Continuation of application No. PCT/EP97/03242, filed on Jun. 20, 1997.

(30) Foreign Application Priority Data

Jun. 25, 1996 (DE) ..... 296 11 143 U

(51) Int. Cl.[7] ..... F01N 3/28; B01J 35/04
(52) U.S. Cl. ..... 428/593; 428/597; 502/527.22
(58) Field of Search ..... 428/593, 603, 428/596, 597; 502/527.22; 422/180

(56) References Cited

U.S. PATENT DOCUMENTS

| | | | | |
|---|---|---|---|---|
| 3,716,344 | * | 2/1973 | Ashburn | 422/180 |
| 4,152,302 | * | 5/1979 | Nonnenmann | 252/472 |
| 4,190,559 | * | 2/1980 | Retallick | 252/477 R |
| 4,402,871 | * | 9/1983 | Retallick | 428/593 |
| 4,576,800 | * | 3/1986 | Retallick | 422/180 |
| 4,597,262 | * | 7/1986 | Retallick | 69/274 |
| 4,598,063 | * | 7/1986 | Retallick | 428/593 |
| 4,647,435 | * | 3/1987 | Nonnenmann | 422/180 |
| 4,665,051 | * | 5/1987 | Nonnenmann | 502/439 |
| 4,987,034 | * | 1/1991 | Hitachi et al. | 428/593 |
| 5,045,403 | * | 9/1991 | Maus et al. | 428/593 |
| 5,130,208 | * | 7/1992 | Maus et al. | 428/593 |
| 5,506,028 | * | 4/1996 | Bruck | 428/116 |

FOREIGN PATENT DOCUMENTS

| | | |
|---|---|---|
| 44 35 913 A1 | 4/1996 | (DE) . |
| 0 152 560 B1 | 7/1987 | (EP) . |
| 0 386 013 B1 | 11/1991 | (EP) . |
| 0 484 364 B1 | 9/1993 | (EP) . |

OTHER PUBLICATIONS

German Utility Model G 89 08 738.0, dated Oct. 19, 1989, honeycombed body with internal flow directing planes, in particular catalytic converter body for motor vehicles.
Japanese Patent Abstract No. 03154639 (Toshihiko), dated Jul. 2, 1991.
Japanese Patent Abstract No. 05138041 (Tsutomu et al.), dated Jun. 1, 1993.
International Patent Application WO 93/20339 (Brück), dated Oct. 14, 1993.

* cited by examiner

*Primary Examiner*—John J. Zimmerman
(74) *Attorney, Agent, or Firm*—Herbert L. Lerner; Laurence A. Greenberg; Werner H. Stemer

(57) ABSTRACT

A conical honeycomb body includes a tubular casing which is conical with respect to an axis. At least one stack in the casing is formed of at least one layer at least partially having waves. The layers bound a plurality of channels through which a fluid can flow. Structures extending substantially in axial direction of the honeycomb body project from the waves of the layers.

16 Claims, 2 Drawing Sheets

CONICAL HONEYCOMB BODY WITH LONGITUDINAL STRUCTURES

CROSS-REFERENCE OF RELATED APPLICATION

This application is a continuation of copending International Application No. PCT/EP97/03242, filed Jun. 20, 1997, which designated the United States.

BACKGROUND OF THE INVENTION

Field of the Invention

The present invention relates to a honeycomb body, in particular a catalyst body for automobiles, including a casing tube being conical relative to an axis, at least one coiled stack disposed in the casing tube and having a multiplicity of metal layers disposed on one another, at least some of the layers at least partially having waves, and a plurality of channels through which a fluid can flow.

Such a honeycomb body is known from International Publication WO 93/20339, corresponding to U.S. Pat. No. 5,506,028. That publication describes a honeycomb body with an axis and with a casing tube which is conical with respect to the latter and into which is fitted a configuration composed of at least one stack coiled around the axis in an involute manner. The stack has a multiplicity of metal layers disposed on one another.

Each layer is shaped in the manner of an annular segment, so that it is limited by an outer arc which is approximately circular with respect to a center point, and by an approximately circular inner arc that is concentric to the outer arc and located between the latter and the center point. Each corrugated layer has waves. The corrugation of a layer does not have a constant wave height over the entire layer. The wave height must increase, ranging from a smaller wave height on the smaller arc limiting the layer to a greater wave height on the larger arc limiting the layer. In that case, the ratio of the wave heights must correspond approximately to the ratio of the lengths of the arcs, so that an approximately conical honeycomb body is obtained when the layer is coiled.

A honeycomb body, as described in International Publication WO 93/20339, corresponding to U.S. Pat. No. 5,506,028, is suitable, in particular, as a carrier for a catalyst in order to bring about a catalytic reaction in a fluid flowing through it. It is suitable, in particular, as a precatalyst for a honeycomb body of a known type, wherein the conical honeycomb body is disposed in a diffuser of the exhaust system immediately upstream of the known honeycomb body. Since the conical honeycomb body serves as a diffuser for the downstream honeycomb bodies which are known per se, a uniform onflow to a following honeycomb body should be achieved. The conically constructed honeycomb body may also be disposed downstream of the honeycomb body, so that it acts as a confuser. The problem of a uniform onflow to a honeycomb body carrying a catalyst is described in European Patent 0 386 013 B1.

In a honeycomb body of the generic type, the structured layers form a multiplicity of channels or ducts, through which a fluid is capable of flowing. In conventional dimensioning, the flow of a fluid in the channels is essentially laminar, since the channel cross section is relatively small. As a result, relatively thick boundary layers form on the channel walls and reduce the contact of the core flow in the channels with the walls. A reduction in the contact of the core flow with the walls leads, under some circumstances, to a reduced catalytic effect of the honeycomb body provided with a catalyst.

European Patent 0 484 364 B1 discloses a honeycomb body, in particular a catalyst carrier body, composed of at least partially structured metal layers which form the walls of a multiplicity of channels, through which a fluid is capable of flowing. In that honeycomb body part of the layers have a main corrugation with wave crests and wave troughs and with a predeterminable wave height. The wave crests and/or wave troughs are provided with a multiplicity of turned-over portions, the height of which is smaller than or equal to the wave height, with the result that channels having additional onflow edges are formed inside. By virtue of that structure of a honeycomb body, which acts as a main catalyst, a higher catalytic conversion rate is achieved, with the same use of material, than in the case of corresponding bodies without any turned-over portions.

Furthermore, European Patent 0 152 560 B1 discloses a honeycomb body in which the corrugations of a metal layer form flow channels that are disposed one behind the other in the direction of flow, but so as to be offset relative to one another transversely thereto. The flow channels are formed by corrugated strips which are provided alternately with wave crests and wave troughs and are directly contiguous with one another at their front and rear edges running transversely to the direction of flow. They are offset relative to one another in each case by a fraction of their wavelength and form an interconnected layer strip. By virtue of that structure of the layers, an increase in turbulence is also achieved in the radial direction within the honeycomb body through which the flow passes. That results in an equalization of the flow profile and in action on the edge zones of the honeycomb body which consequently participate in the reaction and. thereby increase the reaction effect of the honeycomb body.

SUMMARY OF THE INVENTION

It is accordingly an object of the invention to provide a conical honeycomb body with longitudinal structures, which overcomes the hereinafore-mentioned disadvantages of the heretofore-known devices of this general type and which can make a contribution to improved catalytic conversion by virtue of its geometric structure.

With the foregoing and other objects in view there is provided, in accordance with the invention, a conical honeycomb body, comprising an axis defining an axial direction; a casing tube having a conical shape relative to the axis; at least one stack disposed in the casing tube and formed by at least one metal layer at least partially having waves, the at least one stack having a plurality of channels for conducting a fluid flow through the channels; and a multiplicity of structures projecting from the waves and extending substantially in the axial direction.

This structure of the honeycomb body results, on one hand, in a uniform onflow to a honeycomb body following the conical honeycomb body and, on the other hand, in a reduced tendency to form boundary layers during the throughflow of a fluid. Such a honeycomb body has a higher catalytic conversion rate than a corresponding body without structures, with the same amount of material being used. The structures form an integral part of the layers so that they can be formed in the latter, without any additional material being used. The fluid flowing through the honeycomb body is forced to change direction by virtue of the shape of the structures. The individual channels are connected to one another through the use of the structures.

In accordance with another feature of the invention, the structures each extend over part of the axial length of the honeycomb body. As a result, the strength of the honeycomb body is not adversely influenced by the structures.

In accordance with a further feature of the invention, the structures are formed between the wave crests and the wave troughs.

In accordance with an added feature of the invention, in order to increase the number of onflow edges of the structures, the structures are formed by turned-over portions which are formed in the wave troughs and/or on the wave crests.

In accordance with an additional feature of the invention, the height of the turned-over portions is smaller than or equal to the wave height. In the case of the conical honeycomb body, the wave height changes in the axial direction. It is therefore proposed that the height of the turned-over portions change in the axial direction in proportion to the change in wave height.

In order to construct the honeycomb body with even more onflow edges which are not in alignment with one another, two or more structures having different heights may also be produced. Thus, with the same amount of material being used, additional onflow edges are obtained, which cause the honeycomb body to be subdivided as though it had a much greater number of channels than the number of wave crests and wave troughs of the corrugation.

In accordance with yet another feature of the invention, at least two of the structures are formed next to one another and/or one behind the other.

In accordance with yet a further feature of the invention, the structures are offset from one another.

In accordance with a concomitant feature of the invention, the at least one stack is coiled around the axis in an involute manner, the at least one metal layer of the at least one stack is a multiplicity of metal layers disposed on one other, the metal layers include a plurality of corrugated metal layers, each of the metal layers has a center point and is shaped as an annular segment limited by an outer arc approximately circular relative to the center point and an inner arc approximately circular, concentric to the outer arc and located between the outer arc and the center point, each of the corrugated layers has the waves oriented approximately radially relative to the center point, each of the waves has an associated wave height at each of the arcs, the wave heights are in a ratio, and the arcs have lengths in a ratio approximately equal to the ratio of the respective associated wave heights.

Other features which are considered as characteristic for the invention are set forth in the appended claims.

Although the invention is illustrated and described herein as embodied in a conical honeycomb body with longitudinal structures, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
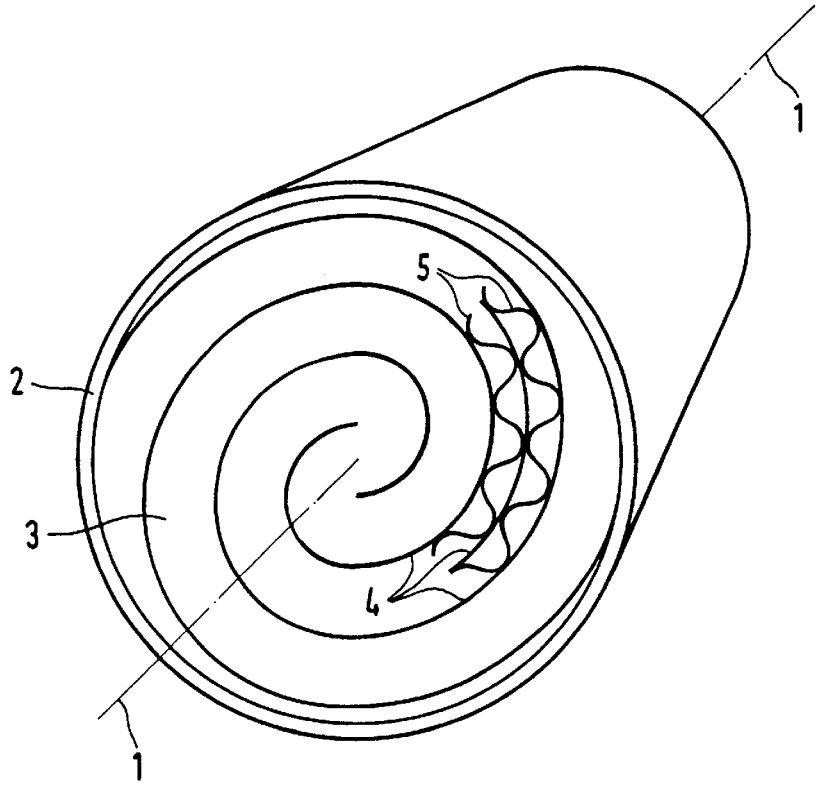
FIG. 1 is a diagrammatic, perspective view of a conical honeycomb body.

Referring now to the figures of the drawings in detail and first, particularly, to FIG. 1 thereof, there is seen a diagrammatic illustration of a honeycomb body. The honeycomb body is constructed conically with respect to an axis 1. The honeycomb body has a stack 3 introduced into a conical casing tube or shell 2 and coiled in an S-shaped manner. The stack 3 includes smooth metal layers or sheets 4 and corrugated metal layers or sheets 5.

Figure 2:
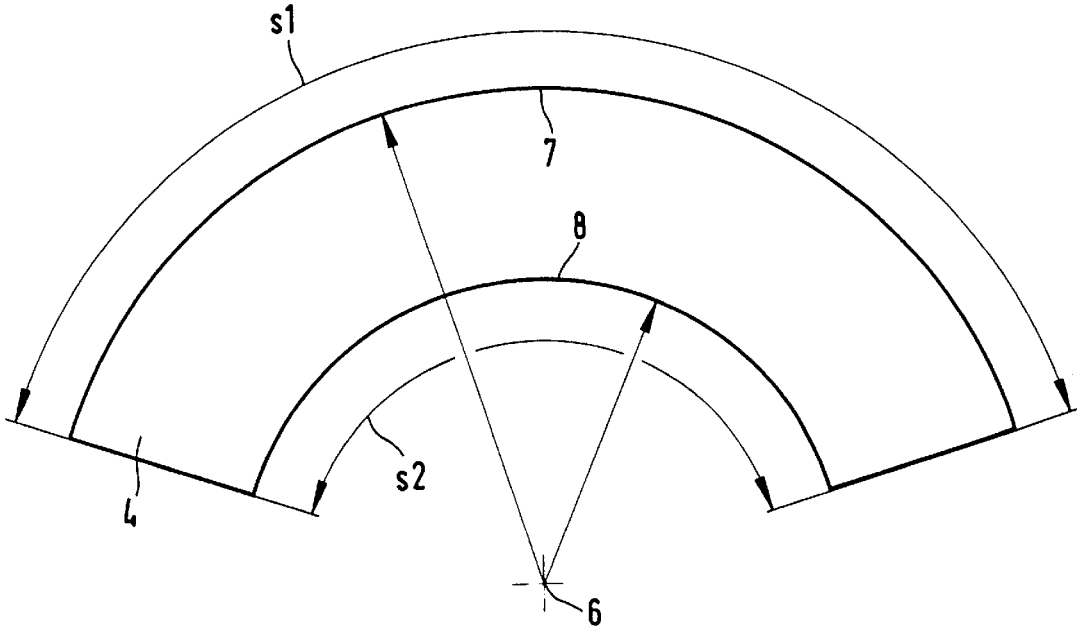
FIG. 2 is a plan view of a smooth layer for forming the honeycomb body.

A smooth layer 4 is illustrated in FIG. 2. The smooth layer 4 is in the form of an annular segment and is limited by an outer arc 7 having a length s1 and an inner arc 8 concentric to the outer arc 7 with respect to a center point 6 and having a length s2. The smooth layer 4 corresponds to a developed view of an envelope of a cone in a plane. A conical honeycomb body can be obtained correspondingly by coiling this smooth layer 4 together with other layers.

Figure 3:
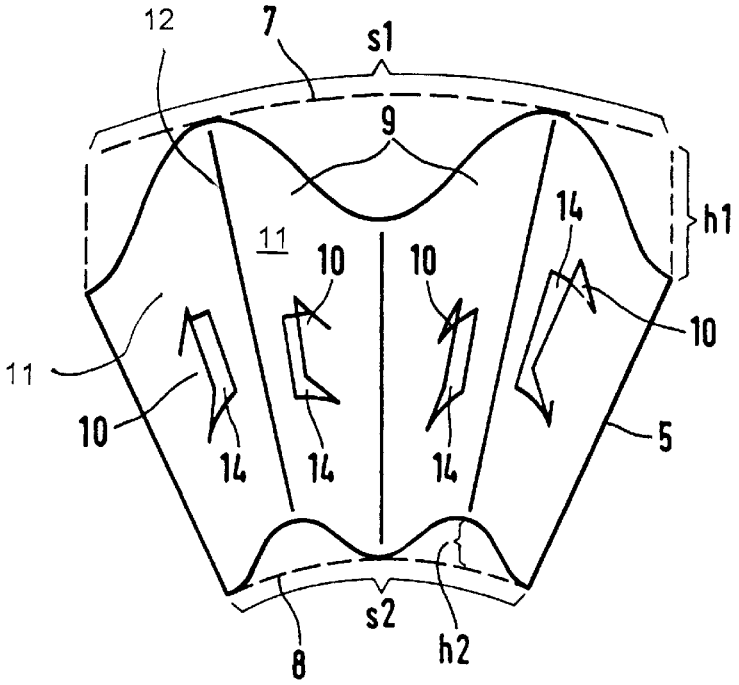
FIG. 3 is a plan view of a corrugated layer.

Reference is made below to FIG. 3 to illustrate the geometry of a corrugated layer 5. The corrugated layer 5 has waves 9. Each wave 9 at the outer arc 7 merges into an individual wave 9 at the inner arc 8. An outer area projected into the plane of the layer 5 corresponds to the shape of an annular segment. The layer 5 is limited by the outer arc 7 having the length s1 and the inner arc 8 having the length s2. The wave 9 has a wave height h1 at the outer arc 7 and a wave height h2 at the inner arc 8. The wave height h1 at the outer arc 7 must be greater than the wave height h2 at the inner arc 8 in accordance with a ratio between the length s1 of the outer arc 7 and the length s2 of the inner arc 8. Layering the smooth layers 4 and the corrugated layers 5 on one another alternately forms the stack 3 which is coiled, for example in involute form, about the axis 1.

The corrugated layer 5 has a multiplicity of structures 10 which project from the waves 9 and which extend essentially in the axial direction. The structures 10 are formed on sides 11 of wave crests 12 and of wave troughs 13. The structures 10 are formed by being punched out in the corrugated layer. In the exemplary embodiment illustrated in FIG. 3, the structures 10 are bent outward. The structures 10 open window-like orifices 14 in the layer 5. A fluid exchange can take place through the orifices 14 between adjacent channels or ducts which are delimited by the corrugated layer.

Figure 4:
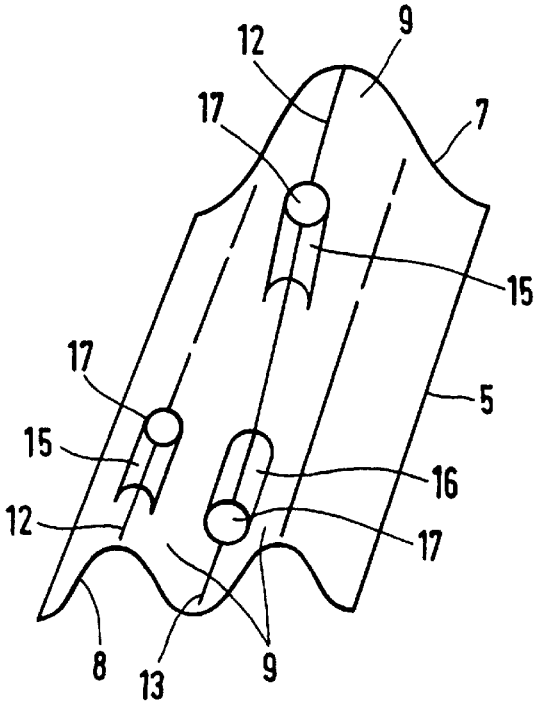
FIG. 4 is a plan view of a layer with structures.

FIG. 4 illustrates a second variant of a corrugated layer 5 with structures which extend essentially in the axial direction of the honeycomb body. According to FIG. 4, one wave 9 at the outer arc 7 merges into two waves 9 at the inner arc 8. A structure 15 is formed on the wave crest 12 of the wave 9 at the outer arc 7. The structure 15 is constructed in the form of a turned-over or turned-up portion which is directed toward the wave trough. A corresponding turned-over portion structure 15 is also formed on the wave crest 12 of the wave 9 at the inner arc 8. Furthermore, the layer 5 is provided with a structure in the form of a turned-over portion 16 which is provided in the wave trough 13 between the two waves 9 at the inner arc 8. The turned-over portion 16 is turned-over upward, that is to say toward the wave crest. The structures 15, 16 form additional channels or ducts 17 for a fluid.

We claim:

1. A conical honeycomb body, comprising:

an axis defining an axial direction;

a casing tube having a conical shape relative to said axis;

at least one stack disposed in said casing tube and formed by at least one metal layer at least partially having waves, said at least one stack having a plurality of channels for conducting a fluid flow through said channels; and a multiplicity of structures projecting from said waves and extending substantially in said axial direction.

2. The honeycomb body according to claim 1, wherein said waves have wave crests and wave troughs, and said structures are formed between said wave crests and said wave troughs.

3. The honeycomb body according to claim 1, wherein said waves have wave crests and wave troughs, and said structures are turned-over portions formed in at least one of said wave troughs and wave crests.

4. The honeycomb body according to claim 3, wherein said waves have a wave height, and said structures have a height at most equal to said wave height.

5. The honeycomb body according to claim 1, wherein at least two of said structures define a line drawn between said structures, and said line is perpendicular to said axis.

6. The honeycomb body according to claim 1, wherein at least two of said structures define a line drawn between said structures, and said line is parallel to said axis.

7. The honeycomb body according to claim 1, wherein:

at least two of said structures define a first line drawn between said structures, and said first line is perpendicular to said axis; and at least two of said structures define a second line drawn between said structures, and said second line is parallel to said axis.

8. The honeycomb body according to claim 1, wherein:

said body has at least two adjacent stacks;

said structures are located on said adjacent stacks; and said structures are offset from one another so as to prevent a fluid from directly flowing between said stacks without travelling along said at least one metal layer.

9. The honeycomb body according to claim 1, wherein said at least one stack is coiled around said axis in an involute manner, said at least one metal layer of said at least one stack is a multiplicity of metal layers disposed on one other, said metal layers include a plurality of corrugated metal layers, each of said metal layers has a center point and is shaped as an annular segment limited by an outer arc approximately circular relative to said center point and an inner arc approximately circular, concentric to said outer arc and located between said outer arc and said center point, each of said corrugated layers has said waves oriented approximately radially relative to said center point, each of said waves has an associated wave height at each of said arcs, said wave heights are in a ratio, and said arcs have lengths in a ratio approximately equal to said ratio of said respective associated wave heights.

10. A conical honeycomb body, comprising:

an axis defining an axial direction;

a casing tube having a conical shape relative to said axis;

at least one annular layer having an outer arc and an inner arc, wherein each of at least one annular layers, at least partially has waves;

at least one stack disposed in said casing tube and formed by said at least one annular layer, wherein:

said at least one stack has a plurality of channels formed by said waves for conducting a fluid flow, at least one of said waves has an outer crest at said outer arc that merges into two waves along said inner arc, said two waves have a first inner crest, a second inner crest, and a mutual inner trough lies between said first inner crest and said second inner crest; and a multiplicity of structures projecting from said waves and extending substantially in said axial direction.

11. The honeycomb body according to claim 10, wherein at least one of said multiplicity of structures is formed on said outer crest.

12. The honeycomb body according to claim 10, wherein at least one of said structures is a turned-over portion on said outer crest that is directed toward said mutual inner trough.

13. The honeycomb body according to claim 10, wherein at least one of said structures is a turned-up portion on said outer crest that is directed toward said mutual inner trough.

14. The honeycomb body according to claim 10, wherein at least one of said structures is formed on one of said first and second inner crests.

15. The honeycomb body according to claim 10, wherein said layer contains at least one of said structures on said mutual inner trough that is turned-over toward said outer crest.

16. A conical honeycomb body, comprising:

an axis defining an axial direction;

a casing tube having a conical shape relative to said axis;

at least one annular layer having an outer arc and an inner arc, wherein each of at least one annular layers, at least partially has waves;

at least one stack disposed in said casing tube and formed by said at least one annular layer, wherein said at least one stack has a plurality of channels for conducting a fluid flow, at least one of said waves having an outer crest at said outer arc that merges into two waves along said inner arc, said two waves have a first inner crest, a second inner crest, and a mutual inner trough lies between said first inner crest and said second inner crest; and a multiplicity of structures projecting from said waves and extending substantially in said axial direction;

at least one of said structure being formed on said outer crest;

at least one of said structures being in the form of a turned-over portion on said outer crest that is directed toward said mutual inner trough;

at least one of said structures being in the form of a turned-up port-ion on said outer crest directed toward said mutual inner trough;

at least one of said structures being formed on one of said first and second inner crests; and said layer containing at least one of said structures on said mutual inner trough that is being turned-over toward said outer crest.

* * * * *